US006902413B1

(12) United States Patent
Moga

(10) Patent No.: US 6,902,413 B1
(45) Date of Patent: Jun. 7, 2005

(54) HIGH RETENTION CONNECTION

(75) Inventor: Viorel N. Moga, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/812,690

(22) Filed: Mar. 30, 2004

(51) Int. Cl.[7] ..... H01R 13/44
(52) U.S. Cl. ..... 439/125; 439/848
(58) Field of Search ..... 439/125, 127, 439/848, 857

(56) References Cited

U.S. PATENT DOCUMENTS 3,678,261 A * 7/1972 McNeil ..... 362/307
5,735,716 A * 4/1998 Bilezikjian ..... 439/843
6,340,303 B2 * 1/2002 Hamada et al. ..... 439/127
6,358,071 B1 3/2002 Moga
6,668,810 B1 * 12/2003 St. John et al. ..... 123/634

* cited by examiner

*Primary Examiner*—Thanh-Tam Le
(74) *Attorney, Agent, or Firm*—Jimmy L. Funke

(57) ABSTRACT

An electrical spring connection assembly electrically connects a conducting case, and a spark plug. The electrical spring connection assembly includes a base having a securing aperture for receiving the conducting case therein. The base fixedly secures the electrical spring connection assembly within the conducting case. The electrical spring connection assembly also includes a leaf spring portion that extends radially out from the base for receiving the spark plug therein. The leaf spring portion creates an engagement force the spark plug must overcome to be positioned within the electrical spring connection assembly. The electrical spring connection assembly also includes a beam spring portion extending out from the leaf spring portion. The beam spring portion creates a retention force to retain the spark plug within the electrical spring connection assembly. The retention force is greater than the engagement force.

8 Claims, 1 Drawing Sheet

FIG - 1
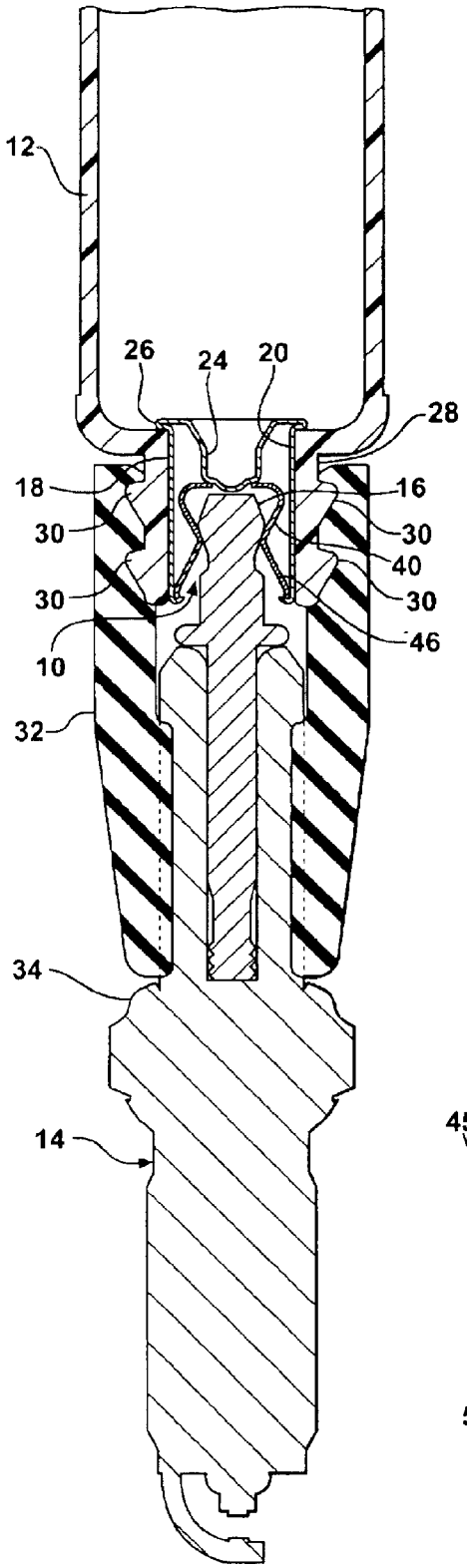
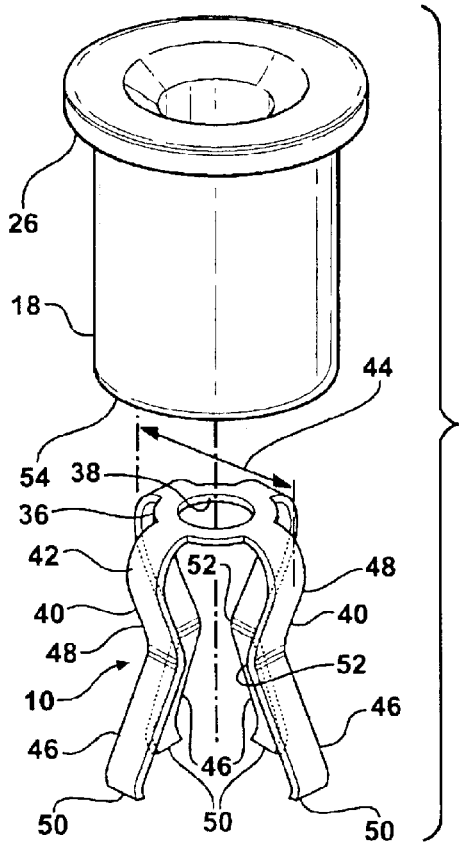
FIG - 2
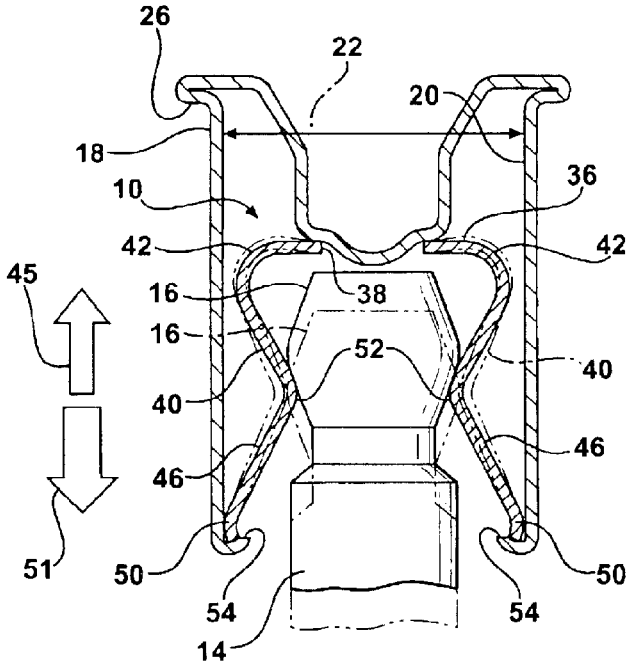
FIG - 3

HIGH RETENTION CONNECTION

BACKGROUND ART

1. Field of the Invention

The invention relates to a connection between a spark ignition coil and a spark plug head. More particularly, the invention relates to a spark plug connector having a multi-point contact system having an increased spring force interface.

2. Description of the Related Art

Electrical connections between high voltage terminals and spark plug heads are well known in the art. Typically, a high voltage lead wire extends from a central high voltage source coil assembly. The lead wire contains a high voltage metal sheath with an insulating coating. The metal conductor sheath is connected to a connector usually formed of a stamped sheet metal which forms an encircling clamp that snaps on to the spark plug head. This arrangement provides little tolerance when assembling the connection. The orientation between the metal conductor sheath and the spark plug head must be substantially identical for the connection to occur.

It is also known to employ a spring within an electrical connection of a spark plug head. These spring designs are complex, costly and do not reliably provide a positive attachment of the spring to the high voltage terminal. These complex designs also require complicated techniques and specialized tools to assemble.

U.S. Pat. 6,358,071, having common inventorship and ownership, discloses a spring that provides an electrical connection for a spark plug head and a high voltage terminal. The spring has contact legs which are slightly compressed by the walls of a connector. These contact legs are leaf springs. While this configuration is simple, the force required to insert the spark plug head into the connector is great. Therefore, a need exists for having a simple spring connection for a spark plug head within a high voltage terminal into which the spark plug is easily inserted and, at the same time, maintain a high retention force on the spark plug head so it is not easily dislodged from the high voltage terminal.

SUMMARY OF THE INVENTION

An electrical spring connection assembly electrically connects a conducting case, having a predetermined case diameter, and a spark plug. The electrical spring connection assembly includes a base having a securing aperture for receiving a portion of the conducting case therein. The base fixedly secures the electrical spring connection assembly within the conducting case. The electrical spring connection assembly also includes a leaf spring portion that extends radially out from the base for receiving the spark plug therein. The leaf spring portion creates a receiving force the spark plug must overcome to be positioned within the electrical spring connection assembly. The electrical spring connection assembly also includes a beam spring extending out from the leaf spring portion. The beam spring portion creates a retention force to retain the spark plug within the electrical spring connection assembly. The retention force is greater than the receiving force.

BRIEF DESCRIPTION OF THE DRAWINGS

Advantages of the invention will be readily appreciated as the same becomes better understood by reference to the following detailed description when considered in connection with the accompanying drawings, wherein:

FIG. 1 is a cross-sectional side view of a spark plug, a conducting case and a pencil ignition coil case partially cut away;

FIG. 2 is an exploded perspective view of one embodiment of the invention being inserted into a conducting case terminal; and FIG. 3 is a cross-sectional side view of the invention inserted into a conducting case with a spark plug head shown in two positions being inserted therein.

DETAILED DESCRIPTION OF THE PREFERRED EMBODIMENT

Referring to the Figures, one embodiment of the invention, an electrical spring connection assembly, is generally indicated at 10. The electrical spring connection assembly 10 is used to electrically connect a high voltage terminal (not shown) within a pencil ignition coil case 12 to a spark plug 14 having a spark plug head 16. Intermediate the pencil ignition coil case 12 and the spark plug head 16 is a conducting case 18. The conducting case 18 defines a cylindrical cavity 20 having a predetermined case diameter 22 (FIG. 3). The conducting case 18 also includes a recess 24 for receiving a portion of the high voltage terminal that is housed within the pencil ignition coil case 12. The conducting case 18 also includes a flange 26 to properly position and retain the conducting case 18 with respect to the pencil ignition coil case 12.

The pencil ignition coil case 12 also includes a connector portion 28 having a plurality of barbs 30 extending out therefrom. The barbs 30 secure the connector portion 28 and, hence, the pencil ignition coil case 12 to an insulating boot 32. The insulating boot 32 surrounds the spark plug head 16 and engages a ceramic insulating portion 34 of the spark plug 14.

The electrical spring connection assembly 10 includes a base 36. The base 36 includes a securing aperture 38 for receiving the recess 24 of the conducting case 18 therein. This allows the electrical spring connection assembly 10 to be fixedly secured to the conducting case 18. The electrical spring connection assembly 10 also includes a leaf spring portion 40 that extends radially out from the base 36. The leaf spring portion 40 receives the spark plug 14 therein. The leaf spring portion 40 includes a bend 42 that extends between the leaf spring portion 40 and the base 36. The bend 42 does not engage the conducting case 18. More specifically, the bend 42 defines a bend diameter 44 that is less than the predetermined case diameter 22 of the high voltage terminal 18. This allows the leaf spring portion 40 to move relative to the cylindrical cavity 20 during insertion of the spark plug head 16 and to the electrical spring connection assembly 10. The leaf spring portion 40 creates an engagement force 45 that must be overcome to insert the spark plug head 16 therein.

The electrical spring connection assembly 10 also includes a beam spring portion 46 that extends out from the leaf spring portion 40. The beam spring portion 46 extends from the leaf spring portion 40 out to the conducting case 18. In the embodiment shown, the leaf spring portion 40 and the beam spring portion 46 create an arm 48. There are a plurality of arms 48 that are included in the electrical spring connection assembly 10. While any number of arms 48 greater than two would effectively allow the electrical spring connection assembly 10 to operate, there are four arms 48 shown in the Figures.

Each of the plurality of arms 48 extends out to a distal end 50. It is the distal end 50 that engages the conducting case 18. The length of the plurality of arms 48 extends over the spark plug 14 only as far as the connector portion 28. This allows the electrical spring connection assembly 10 to be mounted onto the spark plug head 16 off-axis by seven degrees. It should be appreciated that other embodiments may increase the misalignment up to fifteen degrees.

Because the beam spring portion 46 extends down to the distal end 50 of each of the plurality of arms 48, the beam spring portion 46 creates a retention force 51 to retain the spark plug 14 within the electrical spring connection assembly. This retention force is greater than the engagement force 45 of the leaf spring portion 40.

Intermediate the leaf spring portion 40 and the beam spring portion 46 of each of the plurality of arms 48 is a detent 52. It is the detent 52 that delineates the leaf spring portion 40 from the beam spring portion 46. In addition, it is the detent 52 that matingly engages the spark plug head 16 of the spark plug 14 and abuts thereagainst to create the retention force 51.

When assembling the electrical spring connection assembly 10 and the conducting case 18, the cylindrical cavity 20 has a bottom edge 54 (FIG. 2) that is straight. Once the electrical spring connection assembly 10 is inserted into the cylindrical cavity 20, the bottom edge 54 is curled around the distal ends 50 of each of the plurality of arms 48. This secures the electrical spring connection assembly 10 inside the conducting case 18 and further increases the retention force by preventing the distal ends 50 of the arms 48 from moving laterally or longitudinally, thus creating a strong beam spring portion 46.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

What is claimed is:

1. An electrical spring connection assembly for electrically connecting a conducting case, having a predetermined case diameter and a recess, and a spark plug, said electrical spring connection assembly comprising:

a base having a securing aperture for receiving the recess of the conducting case therein to fixedly secure said electrical spring connection assembly within the conducting case;

a leaf spring portion extending radially out from said base for receiving the spark plug therein, said leaf spring portion defining a bend diameter smaller than the predetermined case diameter of the conducting case and creating an engagement force the spark plug must overcome to be positioned within said electrical spring connection assembly; and a beam spring portion extending out from said leaf spring portion, said beam spring portion defining a beam diameter greater than the predetermined case diameter of the conducting case and creating a retention force to retain the spark plug within said electrical spring connection assembly, said retention force being greater than said engagement force.

2. An electrical spring connection assembly as set forth in claim 1 including a detent extending between said leaf spring portion and said beam spring portion.

3. An electrical spring connection assembly as set forth in claim 2 wherein said leaf and beam spring portions include a plurality of arms extending out from said base radially therefrom.

4. An electrical spring connection assembly as set forth in claim 3 wherein each of said plurality of arms includes a distal end.

5. An electrical spring connection assembly as set forth in claim 4 wherein each of said distal ends matingly engages the conducting case.

6. An electrical spring connection assembly as set forth in claim 5 wherein each of said plurality of arms is spaced equidistantly from said base.

7. An electrical spring connection assembly as set forth in claim 6 wherein said leaf spring portion includes a bend extending out from said base that does not engage the conducting case.

8. An electrical spring connection assembly as set forth in claim 5 wherein said distal ends are bent inwardly to matingly engage the conducting case such that said retention force of said electrical spring connection is increased by immobility of said distal ends.

* * * * *